United States Patent [19]

Gebler

[11] 4,077,600

[45] * Mar. 7, 1978

[54] INGOT MOLD BASE MEMBER

[75] Inventor: Kenneth A. Gebler, Munster, Ind.

[73] Assignee: Nalco Chemical Company, Oak Brook, Ill.

[ * ] Notice: The portion of the term of this patent subsequent to Feb. 1, 1994, has been disclaimed.

[21] Appl. No.: 740,698

[22] Filed: Nov. 11, 1976

Related U.S. Application Data

[63] Continuation of Ser. No. 633,359, Nov. 19, 1975, Pat. No. 4,005,846.

[51] Int. Cl.[2] ..... B22D 7/06; B22D 19/10

[52] U.S. Cl. ..... 249/204; 29/402

[58] Field of Search ..... 249/174, 204, 205, 106, 249/197, 198, 202; 29/401 R, 401 D, 401 A, 401 E, 402; 264/30, 35, 219, 225; 164/92, 412; 425/11; 432/3

[56] References Cited

U.S. PATENT DOCUMENTS

| | | | |
|---|---|---|---|
| 3,396,961 | 8/1968 | Farrington | 264/30 |
| 3,415,631 | 12/1968 | Ault | 264/30 |
| 3,629,928 | 12/1971 | Hammerle | 249/174 X |
| 3,807,684 | 4/1974 | Kurihara | 249/204 |
| 3,874,628 | 4/1975 | Jarron | 249/204 |
| 3,918,624 | 11/1975 | Kurihara | 164/112 X |
| 4,005,742 | 2/1977 | Kachik | 164/92 X |

*Primary Examiner*—Francis S. Husar
*Assistant Examiner*—John S. Brown
*Attorney, Agent, or Firm*—John G. Premo; Robert A. Miller; Barry W. Sufrin

[57] ABSTRACT

An improved ingot mold base member comprising a cast iron base with a refractory insert disposed within its face. The refractory insert is positioned within a cavity in the cast iron base and attached with Z-shaped anchors, said anchors contacting a groove in the side of the insert and fastened to the bottom of the cavity. A channel between the edge of the refractory insert and the edge of the cavity is filled with a plastic refractory.

3 Claims, 4 Drawing Figures

INGOT MOLD BASE MEMBER

This is a continuation of application Ser. No. 633,359 filed on Nov. 19, 1975 now U.S. Pat. No. 4,005,846.

BACKGROUND OF THE INVENTION

Field of the Invention

All metal ingots are cast from molds. These molds rest on bases commonly known as "stools. " The stools are large, normally rectangular, flat slabs of metal usually made of cast iron. The stools are used as support for the mold sides and also to form the bottom portion of the mold. In a "big end down" type of mold, the mold sides generally taper down in diameter from bottom to top. In another type of mold, known as the "big end up" mold, there is a ladle-like receiver for the molten metal, the bottom portion of which is an integral non-removal part of the entire mold.

Various problems commonly occur in use of these molds and particularly with respect to the surface of their base portions. The unprotected metal surface on the base portion quickly erodes and pits in the presence of molten metal which is cascaded upon its surface. Large gouges in the base portions are produced due to the force and high temperature developed by the flowing molten metal which contacts the surface of the stool.

Since many molds are generally 5–10 feet in height, the metal must be poured from a height at least equal to that distance and quite often is poured from even greater heights. A considerable pressure head thereby developed. Thus, the hot molten metal easily gouges gaping depressions in the base members under such force and at a temperature of at least the liquefaction temperature of the molten metal. Moreover, the problem of creation of pits or gouges in the base portions of the molds, caused by the above factors, is aggravated due to the fact that the moten metal, especially near the bottom of the mold, remains in its erosive hot liquid state for a considerable amount of time subsequent to pouring.

The molten metal, after solidification to an ingot has a bottom from conforming to the undesirable eroded surface configuration of the stool or base member of the mold. Thus, a considerable amount of the ingot, when withdrawn from the mold and subsequently processed into slabs or blooms, is lost through a cropping of the irregularly formed end of the slab. This, of course, is highly undesirable, since it results in undue loss of usable metal and an increase in scrap which must be subsequently reprocessed.

Another extremely serious and costly problem arises after the ingot in the mold has solidified to a point where it can be removed from both the mold sides and its base platform member or stool. If the surface of the stool is unprotected or inadequately protected and erosion occurs as described above, the ingot has a greater tendency to remain tightly adherent to the stool. Thus, after the mold sides are removed from around the ingot, which process can normally be efficiently achieved with a minimal film of coating selected from a variety of coating agent, the ingot must be forcibly removed from the stool.

Removal is normally achieved by raising both ingot and adherent stool, and thrusting them against some other larger object whereby the ingot is jarred loose. In many cases the stool and ingot are merely dropped on the floor some suitable height. In such a situation, the stool is often broken into two or more smaller pieces and cannot be subsequently reused in casting other ingots. Again, replacement cost of these stools is high, making this aspect of the overall casting process somewhat disadvantageous. The same problem exists with respect to big end up molds wherein sticking of ingots particularly occurs at their base portion. New molds of this type are especially vulnerable to sticking due to their smooth surface unprotected by any layers of metal oxides or scale. A tight metal-to-metal bond between mold bottoms and ingots then occurs.

Cracking of molds particularly cracking of their base portions due to the above discussed rough handling occasioned by "stickers" between the base portions and ingots is enhanced by thermal shock during ingot formation. Unprotected or inadequately protected bottom surfaces of molds are especially susceptible to such destructive shock.

DESCRIPTION OF THE PRIOR ART

Many ways of alleviating the above described problems in connection with the erosion of base members of ingot molds have been proposed in the prior art. A number of refractory coatings have been suggested but these are not entirely satisfactory.

An early solution to the erosion of ingot mold stools resided in the suggestion that refractory inserts could be placed into the bottom of the mold, which refractory would tend to minimize erosion.

However, ceramic inserts have not met with any degree of commercial success. The main drawback of the ceramic inserts relates to the difficulty of anchoring them to the stools. Molten metal tends to work its way into the space between the insert and the stool due to capillary action. In the absence of a sufficient anchoring system, this molten metal tends to force the ceramic insert from its cavity. When this occurs, the ceramic insert positions itself above the top surface of the stool and tends to become entrained within the metal ingot. This entrainment causes a number of problems including the formation of metal inclusions in the ingot which necessitate an expensive operation known as butt cropping.

If it were possible to produce an improved method for anchoring the ceramic inserts, a substantial advance to the art would be afforded.

OBJECTS OF THE INVENTION

It is, therefore, an object of the present invention to provide an improved method for anchoring refractory inserts in the base members of the ingot molds.

Another object of the present invention is to provide a practical method for casting metal ingots upon stools utilizing a stool containing a refractory insert.

Another object of the present invention is to provide a method for repairing base members of ingot molds by anchoring a refractory insert in the surface of the base member.

Other objects will appear hereinafter.

BRIEF DESCRIPTION OF THE DRAWINGS

FIG. I is an isometric view of a stool insert.

FIG. II is a top view of a stool showing a preformed cavity and a refractory insert anchored therein.

Figure 1:
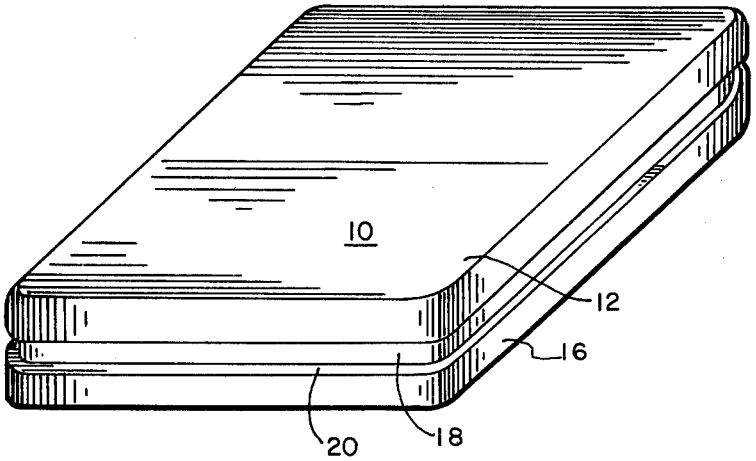
Figure 2:
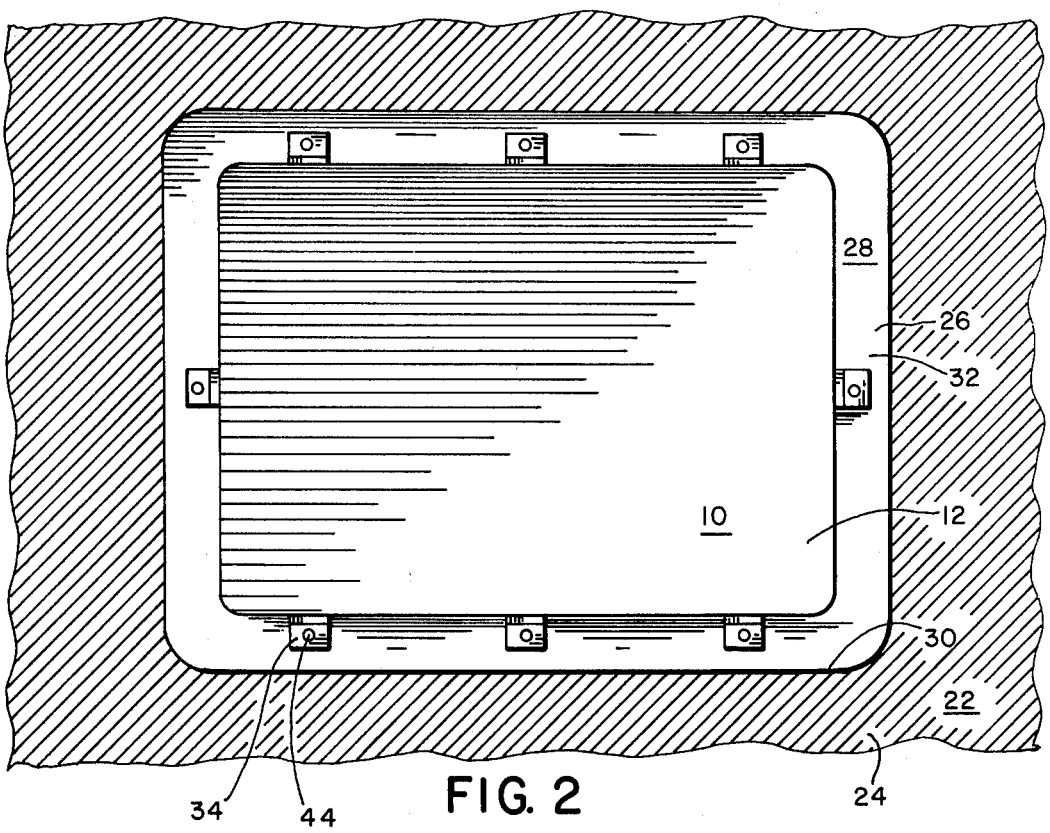
Figure 3:
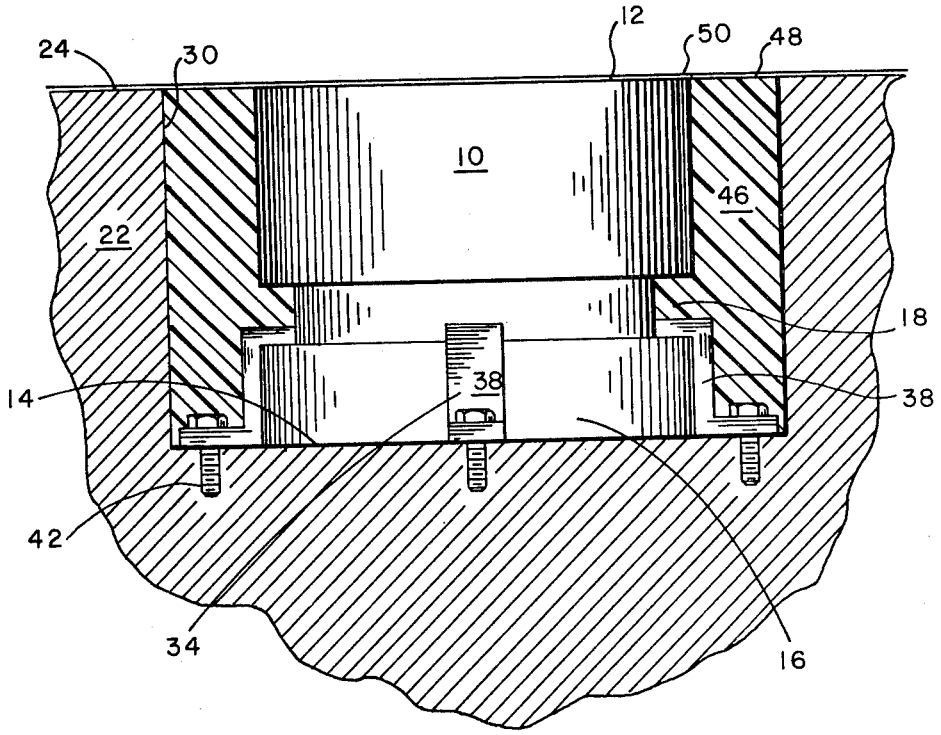
Figure 4:
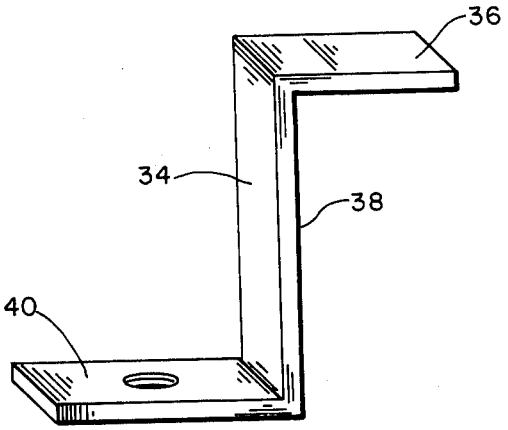

FIG. III is a horizontal view of a stool cavity containing anchored therein by Z-shaped anchors, a refractory insert and containing a plastic refractory filler.

FIG. IV is an enlarged view of a Z-shaped anchor.

With more specific reference to the drawings wherein like parts have like numbers, there is shown a refractory insert 10 of substantially rectangular dimension, with a top 12, a bottom 14 and with a side 16 running along its entire perimeter. The refractory insert 10 contains a groove 18 in its side 16 running completely about its perimeter and located near the bottom 14 of the insert 10. The groove 18 has a bottom surface 20 positioned approximately parallel to the bottom 14 of the refractory insert 10.

The base member of the ingot mold, referred to herein as stool 22, has a top surface 24 with a cavity 26 located in said top surface 24. The cavity 26 has a bottom 28 and a side 30 running about its perimeter.

The refractory insert 10 is located within the cavity 26 with the top face 12 of the insert substantially flush with the top surface 24 of the stool 22. The refractory insert 10 is of approximately the same shape as the cavity 24 but is of substantially less dimension than said cavity 26 so that a channel 32 is defined between the side 16 of the refractory insert 10 and the side 30 of the cavity 26.

The refractory insert 10 is anchored to the bottom surface 28 of the cavity 26 by means of Z-shaped anchors 34. Each anchor 34 has a top horizontal member 36, a vertical member 38 and a bottom horizontal member 40. The top horizontal member 36 of each anchor 34 is positioned upon the bottom surface 20 of the groove 18, with the vertical member 38 touching the side 16 of the refractory insert and of sufficient length to allow the bottom horizontal member 40 of the anchor 34 to be fastened to the bottom 28 of the cavity 26. The anchor 34 is attached to the bottom 28 of the cavity 26 by means of a hardened steel nail 42 with head 44. The anchors 34 are positioned within the channel 32 and located at substantially regular intervals along the side 16 of the refractory insert 10.

The channel 32 is filled with a plastic refractory 46 so that the top surface 48 of the plastic refractory 46 is flush with both the top 12 of the refractory insert 10 and the top surface 24 of the stool 22. The surface 24 of the stool 22 is then optionally treated with a thin coating of a refractory composition 50, said refractory composition also covering the top surface 12 of the refractory insert 10 and the top surface 48 of the plastic refractory 46.

BRIEF SUMMARY OF THE INVENTION

The Refractory Insert

The refractory insert is square in cross section may be of any of a number of shapes including oval, circular and rectangular. A common rectangular size is 45 × 30 inches. Generally, the refractory insert will be at least 4 inches thick and usually at least 6 inches thick.

The groove in the side of the refractory insert must be large enough to accept the top horizontal member of the anchor and is usually at least 1 inch wide and 1 inch deep. It is usually located as far from the top surface of the insert as practically possible in order to reduce the exposure of the top horizontal and vertical members of the anchor to the intense heat of the molten metal poured onto the surface of the stool. As the distance between the anchor and this surface decreases due to wearing of the insert and the stool, melting of the anchor may occur. When locating the groove, it is important to leave a sufficient amount of material between the bottom surface of the groove and the bottom of the insert in order to prevent the collar thus defined from breaking off of the insert due to stresses experienced during its use.

The refractory insert is fromed from a refractory material composed predominently of alumina and containing other ingredients such as inorganic phosphates, water, clay and the like. These compositions should contain at least 40% by weight of alumina and preferably at least 60% by weight. Typical high alumina refractories are discussed and described in U.S. Pat. No. 3,547,664 and certain of the references cited thereagainst. This patent and the pertinent references are hereby incorporated by reference.

A preferred refractory composition of the type useful in forming the insert has the following composition:

| | |
|---|---|
| Tabular alumina (6 mesh) | 60% |
| Calcined alumina (−325 mesh) | 28 |
| Kyanite (48 mesh) | 5 |
| Kaolin clay | 3 |
| Phosphoric acid (85%) $H_3PO_4$ | 4 |
| Ceramic fiber | 0.12 |
| Water | 4 |

In addition to the compositions of the sort just described, the invention contemplates using other moldable ceramic materials which are thermally resistant to contact with molten metal.

The refractory insert is formed by shaping the refractory composition in a mold and heating for at least 1 hour at 230° F to 600° F in order to set the refractory and to drive off water. The minimum set required will produce an insert that will not crumble or seriously deform when it is removed from the mold. In a preferred embodiment, a "pre-fired" insert prepared by heating the molded refractory to between 250° F and 600° F for at least one hour followed by heating at 2500° F for at least 30 minutes is used. This "pre-firing" method produces a more durable insert with stronger ceramic bonds than are otherwise obtained.

The Plastic Refractory

The plastic refractory may be of a composition similar to that of the refractory insert described above. Generally, it should contain at least 40% by weight alumina and preferably at least 60% by weight. In a most preferred embodiment, the plastic refractory will contain at least 85% alumina.

Water may be added to the composition for improving its plasticity and workability. A certain amount of clay is essential to the refractory composition in order to provide plasticity and workability. The plasticity required will vary according to the method of application. For example, when the refractory is applied by means of pneumatic ramming, which is discussed in more detail below, at least 2% of clay must be present in the mix to achieve the necessary plasticity and workability. (See U.S. Pat. No. 3,547,664, which is hereby incorporated by reference).

One useful method of applying the refractory is to merely place a plastic refractory of a soft mud consistency into the channel between the insert and the edge of the stool cavity followed by tamping with a convenient tool such as a solid steel bar. A preferred method for emplacing the plastic refractory is to prepare a slightly heavier consistency composition and to place it in a position by ramming with a pneumatic ramming gun. The pneumatic ramming gun, which may be generally described as an air operated pistol, pounds the refractory down with extreme force thereby improving the seal between the plastic refractory and the edges of the insert and the cavity.

After the channel is filled with the plastic refractory, it must be heated to set the bond and drive off excess moisture. The heating temperature must be above the boiling point of water ranging up to approximately 600° F. Generally, heating should continue for at least one hour.

The Z-Shaped Anchors

The anchors employed in the present invention are preferably Z-shaped as depicted in FIG. III. They may be formed from a single length of strap steel or other suitable material which is at least one-sixteenth inch thick and at least one-half inch wide. Preferably, the anchor is at least 1 inch wide. The Z-shaped configuration is preferred, although minor modifications thereof may be made.

It is believed that an important advantage of the present invention resides in fastening the Z-shaped anchors to the cavity of the stool in such a manner that the base portion of the anchor is in the same plane as the surface of the cavity. When the base portion of the Z-shaped anchor contacts the cavity wall in this way, heat transfer is maximized. Thus, localized hot spotting which could occur when the stool contacts molten metal is minimized.

The Z bars may be rapidly and conveniently anchored to the cavity through the use of hardened steel nails which are inserted through the base of the Z-shaped anchor and into the bottom of the cavity in the stool by means of a cartridge actuated nail driving impact tool. The penetration of the hardened steel nail into the stool should be at least one-half inch and preferably at least three-fourths inch. A useful modification of the above method entails the use of threaded studs instead of nails. Once the studs are secured to the bottom of the stool cavity, Z-shaped anchors containing a hole in their base portion are conveniently attached to them.

A minimum of 2 anchors per insert are required. For a rectangular insert, usually 2 and preferably at least 3 anchors per side will be used. Preferably, the anchors will be spaced at approximately 8 inch intervals about the perimeter of the insert.

CONCLUSION

The present invention may be practiced with stools into which an appropriate cavity for receiving the refractory insert has been cast. The invention may also be practiced with both new and used stools into which such a cavity is formed at some time subsequent to the casting of the stool.

Stools structured as described above, may be used for casting without further preparation. It is preferred, however, to coat the entire surface of the stool with a thin coating of a refractory composition commonly referred to as a "stool coating. " This stool coating forms an insulating hard layer on the top face of the stool which prevents sticking of ingots. Stool coatings are well known in the art and are described, for example, in U.S. Pat. Nos. 3,184,813 and 3,184,815 which are hereby incorporated by reference.

Stools fitted with refractory inserts and generally treated according to the method of the present invention may be used for casting metal with a minimum of pitting and a minimum of difficulties in separating the mold from the stool. Stool life is significantly extended since damaged inserts may be merely replaced when they become objectionably pitted, cracked or broken. Similarly, the useful life of used stools may be increased by fitting them with refractory inserts.

An important advantage of the present invention is that the only material requiring on site drying is the plastic refractory which fills the channel. This is in contrast to systems requiring patching of the entire damaged area with a refractory requiring subsequent drying. In addition, since the insert comes preformed under the present disclosed system, the possibility of poor workmanship in the filling of the stool cavity is minimized.

I claim:

1. An ingot mold base member comprising:

(A) a cast iron base with a cavity formed within its top, said cavity having a bottom and a side running along its perimeter;

(B) a refractory insert disposed within said cavity, said refractory insert having a top, a bottom and a side running along its perimeter, said refractory insert of approximately the same shape as said cavity but of substantially less dimension, said insert thereby defining a channel between the side of said cavity and the side of said insert, said refractory insert containing a groove having a square cross section in its side, said groove having a bottom surface positioned approximately parallel to the bottom surface of said refractory insert;

(C) anchor means fastened to the bottom of said cavity and engaging at least a portion of said groove; and (D) a plastic refractory substantially filling said channel.

2. An ingot mold base member constructed according to the teaching of claim 1 wherein said plastic refractory contains at least 60% alumina.

3. The ingot mold base member of claim 1 wherein the refractory insert is at least 4 inches thick.

* * * * *